US010822830B2

(12) United States Patent
Vergani et al.

(10) Patent No.: US 10,822,830 B2
(45) Date of Patent: Nov. 3, 2020

(54) MULTI-DIRECTIONAL HANDLE

(71) Applicant: Umberto Vergani, Seregno (IT)

(72) Inventors: Umberto Vergani, Seregno (IT); Davide Adriano, Turin (IT); Gabriele Adriano, Turin (IT)

(73) Assignee: Umberto Vergani, Seregno (MB), OT (IT)

( * ) Notice: Subject to any disclaimer, the term of this patent is extended or adjusted under 35 U.S.C. 154(b) by 180 days.

(21) Appl. No.: 16/072,463

(22) PCT Filed: Dec. 16, 2016

(86) PCT No.: PCT/IT2016/000296

§ 371 (c)(1),
(2) Date: Jul. 24, 2018

(87) PCT Pub. No.: WO2017/130231

PCT Pub. Date: Aug. 3, 2017

(65) Prior Publication Data

US 2019/0032365 A1 Jan. 31, 2019

(30) Foreign Application Priority Data

Jan. 29, 2016 (IT) ..... UB20160350

(51) Int. Cl.
*E05B 15/00* (2006.01)
*E05B 1/00* (2006.01)
*E05B 63/00* (2006.01)

(52) U.S. Cl.
CPC ..... *E05B 1/0092* (2013.01); *E05B 15/0033* (2013.01); *E05B 63/0056* (2013.01); *E05Y 2900/132* (2013.01)

(58) Field of Classification Search
CPC ..... E05B 1/0092; E05B 15/0033; E05B 63/0056; E05Y 2900/132
(Continued)

(56) References Cited

U.S. PATENT DOCUMENTS 5,947,535 A 9/1999 Baker
6,141,998 A 11/2000 Seo
(Continued)

FOREIGN PATENT DOCUMENTS

EP 0663502 A1 7/1995

OTHER PUBLICATIONS

European Patent Office, International Search Report issued in parent International Patent Application No. PCT/IT2016/000296 dated Apr. 20, 2017, 3 pages.
(Continued)

*Primary Examiner* — Suzanne L Barrett
(74) *Attorney, Agent, or Firm* — Danton Mak, Esq.; William Thomas Babbitt, Esq.

(57) ABSTRACT

A multidirectional handle (10) is described, comprising a grip (11) assembled on a hollow handle body (46); a lever (12) associated with the grip (11) and with a lever support (14) contained in the handle body (46) and rotating together with grip (11) and lever support (14) and oscillating on the lever support (14); a first and a second cam elements (16, 18) associated with the lever (12); a revolving element (35) associated with the second cam element (18); and a connecting bar (45) connected to the revolving element (35) and adapted to connect the handle (10) to a lock.

10 Claims, 4 Drawing Sheets

(58) Field of Classification Search
USPC .... 70/91, 221–224, 218, 145, 149, 422, 472
See application file for complete search history.

(56) References Cited

U.S. PATENT DOCUMENTS

| | | | | |
|---|---|---|---|---|
| 8,939,477 | B2 * | 1/2015 | Welsby | E05B 55/005 292/347 |
| 9,945,152 | B2 * | 4/2018 | Huang | E05B 17/044 |
| 10,047,550 | B2 * | 8/2018 | Ou | E05C 1/12 |
| 2008/0314096 | A1 | 12/2008 | Kim | |
| 2015/0075236 | A1 | 3/2015 | Ou et al. | |
| 2019/0032365 | A1 * | 1/2019 | Vergani | E05B 15/0033 |

OTHER PUBLICATIONS

European Patent Office, Written Opinion of the International Searching Authority issued in parent International Patent Application No. PCT/IT2016/000296 dated Apr. 20, 2017, 5 pages.

* cited by examiner

MULTI-DIRECTIONAL HANDLE

CROSS-REFERENCE TO RELATED APPLICATIONS

The present Application is a national stage of International Patent Application No. PCT/IT2016/000296, titled "Multi-Directional Handle," filed Dec. 16, 2016, which claims priority from Italian Patent Application No. ITUB20160350 filed Jan. 29, 2016, the contents of which are incorporated in this disclosure by reference in their entirety.

BACKGROUND OF THE INVENTION

1) Field of the Invention

The present invention refers to a handle, in particular a handle for doors, adapted to be used with different opening modes.

2) Background Art

Two main types of locks for doors are known in the art, the European or recessed lock, and the Anglo-Saxon or American lock, with which two different types of handles are used.

In European locks, the lock latch is separated from the bolt, the handle is connected to the lock mechanism through a connecting bar called "quadrotto", and controls the latch movement only, while the mechanism for converting the motion from rotary into rectilinear is integrated in the lock block.

In Anglo-Saxon locks, the handle comprises the mechanism for converting the motion from rotary into rectilinear integrated therein, controls the lock latch and can further contain an integrated blocking mechanism through a key or a leverage.

These handles and their corresponding locks, however, are not satisfactory and have the following problems:

- in European or recessed locks, the handles can be easily replaced, but the lock has a cumbersome installation on the door and its assembling on glass doors is problematic;
- in Anglo-Saxon locks, the handles can be replaced only by other handles which have the same internal mechanisms, and cannot be installed on doors as replacements of already installed handles and recessed locks.

In general, known handles have the problem of not allowing the use of a handle on doors which have an already installed recessed lock for adding a multidirectional opening mechanism without replacing the lock.

SUMMARY OF THE INVENTION

Object of the present invention is providing a multi-directional handle which can be assembled on doors having an already installed recessed lock for adding a multi-directional opening mechanism without requiring replacement of the lock.

Another object of the present invention is providing a multi-directional handle which allows an easy installation on glass doors.

A further object of the present invention is providing a multi-directional handle which can be used either with a closing mechanism or with lock integrated in the handle and separated therefrom.

The above and other objects and advantages of the invention, as will result from the following description, are obtained with a multi-directional handle as claimed in claim 1. Preferred embodiments and non-trivial variations of the present invention are the subject matter of the dependent claims.

It is intended that the enclosed claims are an integral part of the present description.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
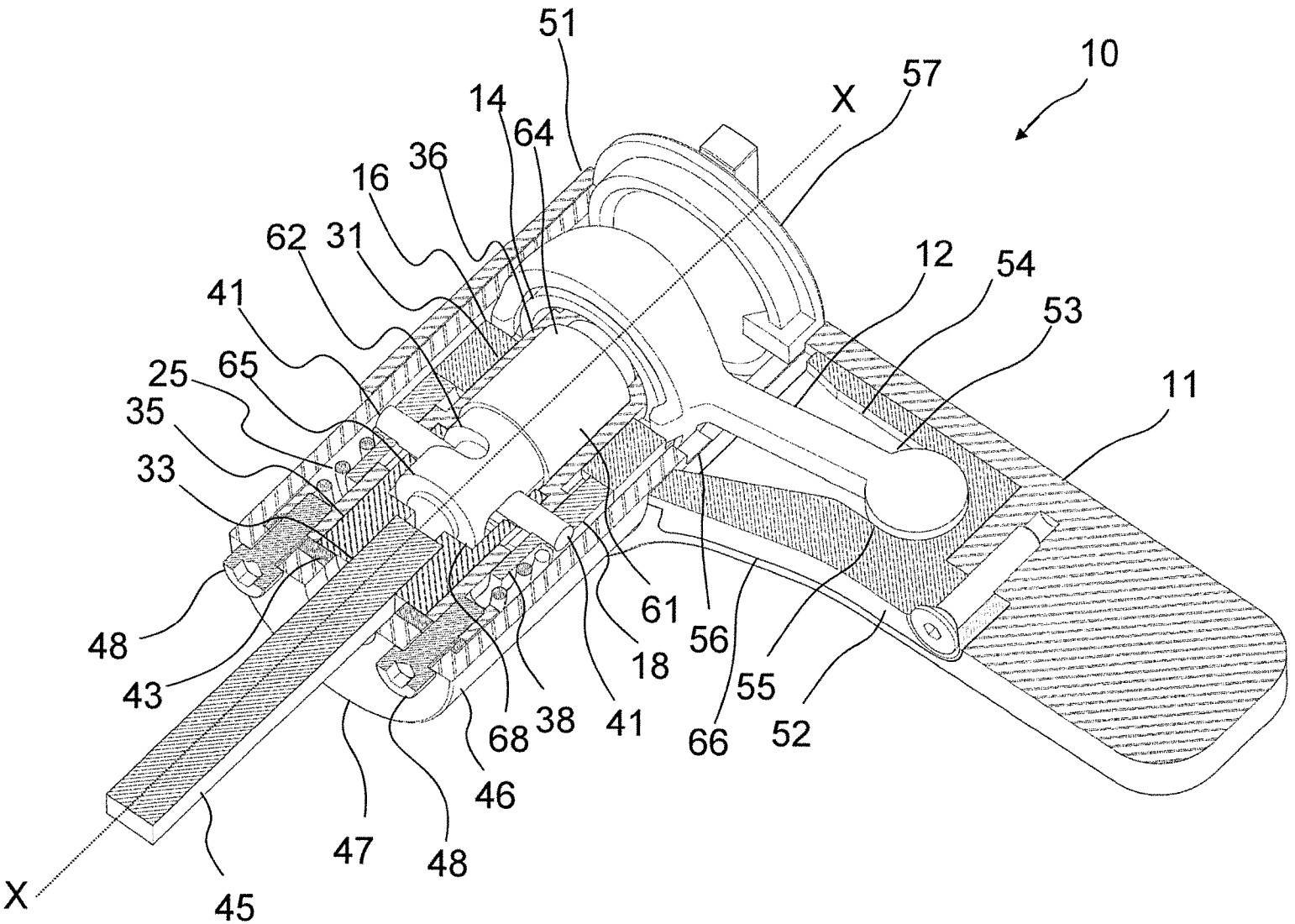
FIG. 1 is a perspective view of a section of a multidirectional handle according to the present invention.
Figure 2:
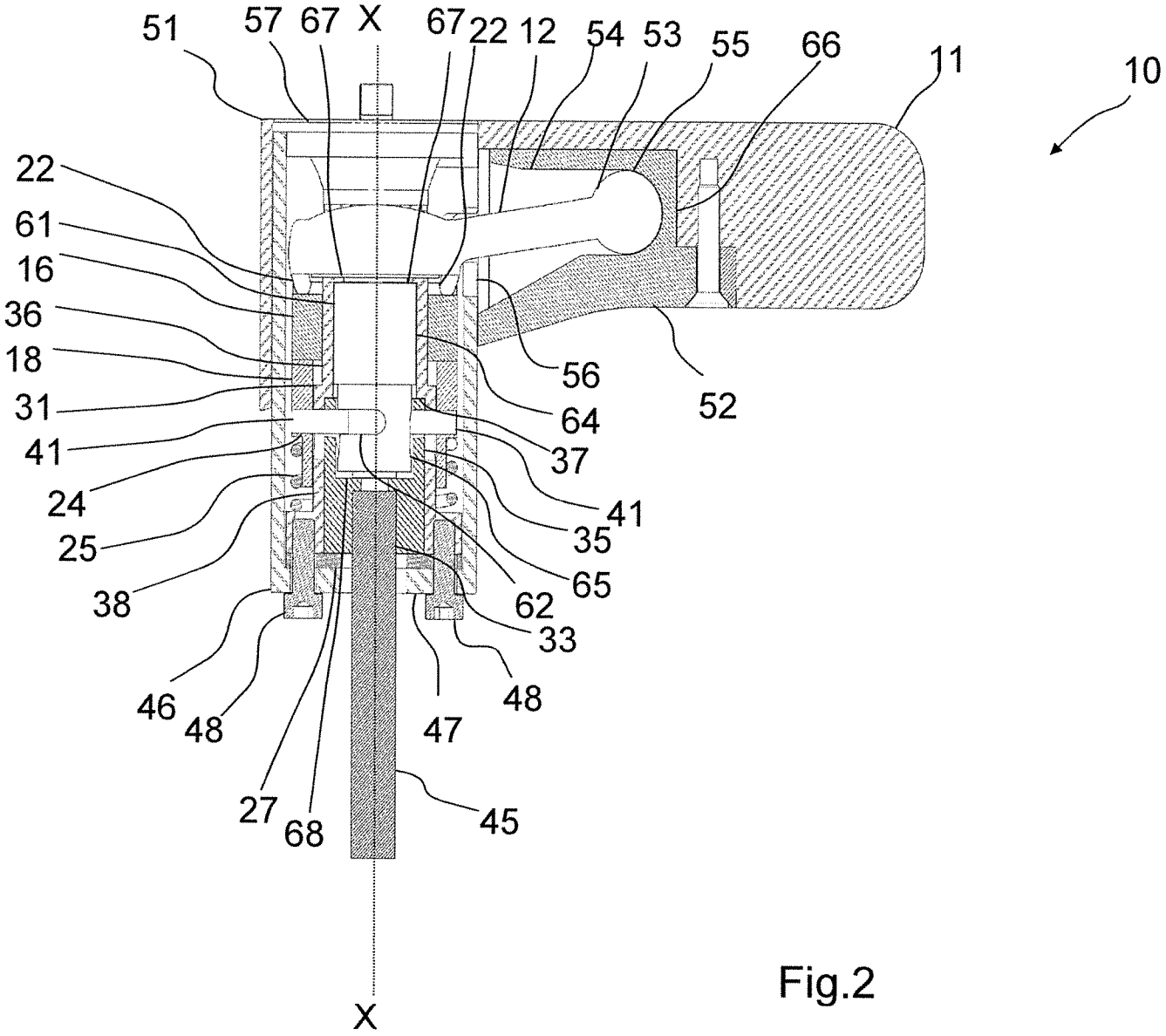
FIG. 2 is a side view of a section of a multi-directional handle according to the present invention.
Figure 3:
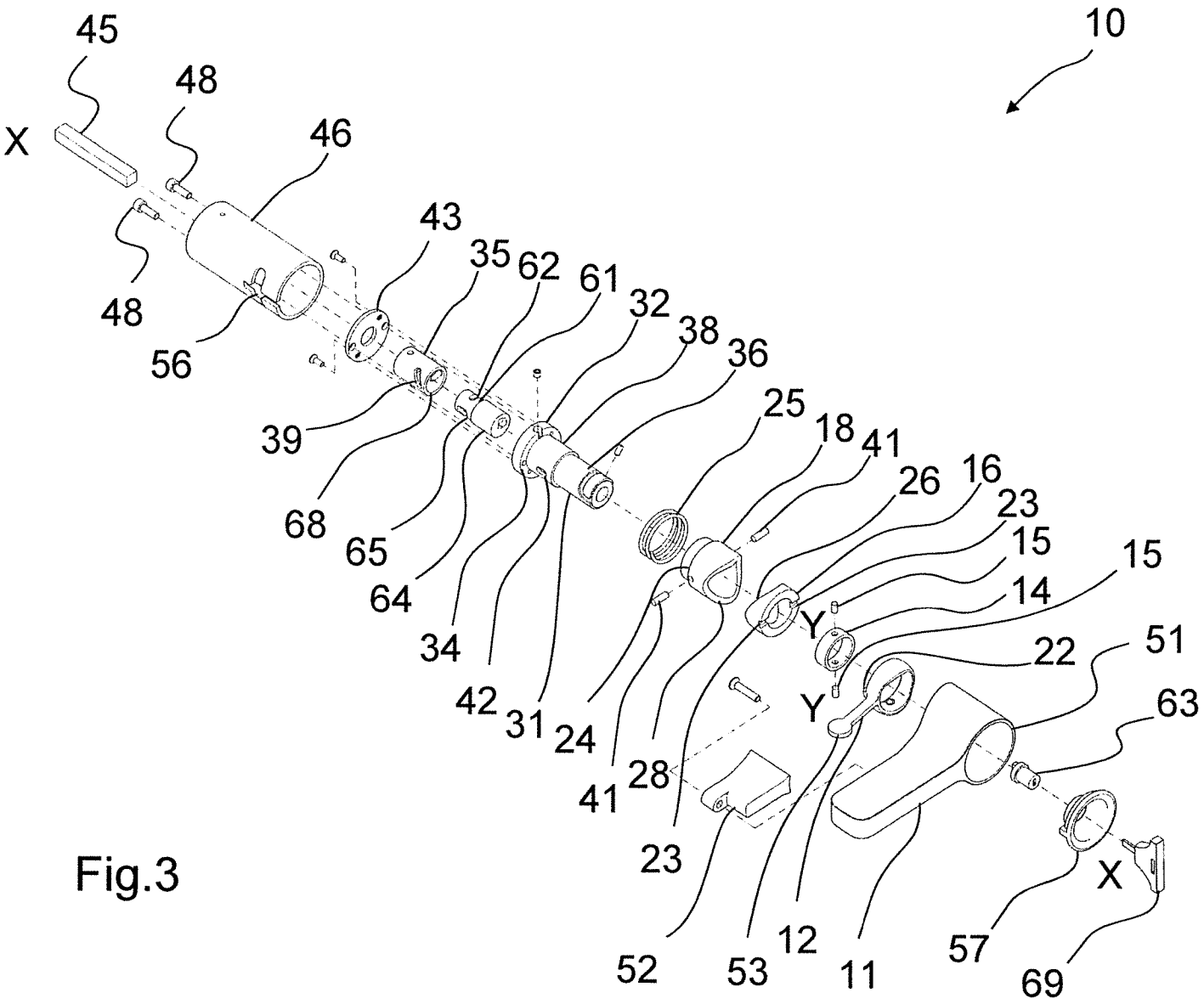
FIG. 3 is an exploded view of a multi-directional handle according to the present invention.
Figure 4:
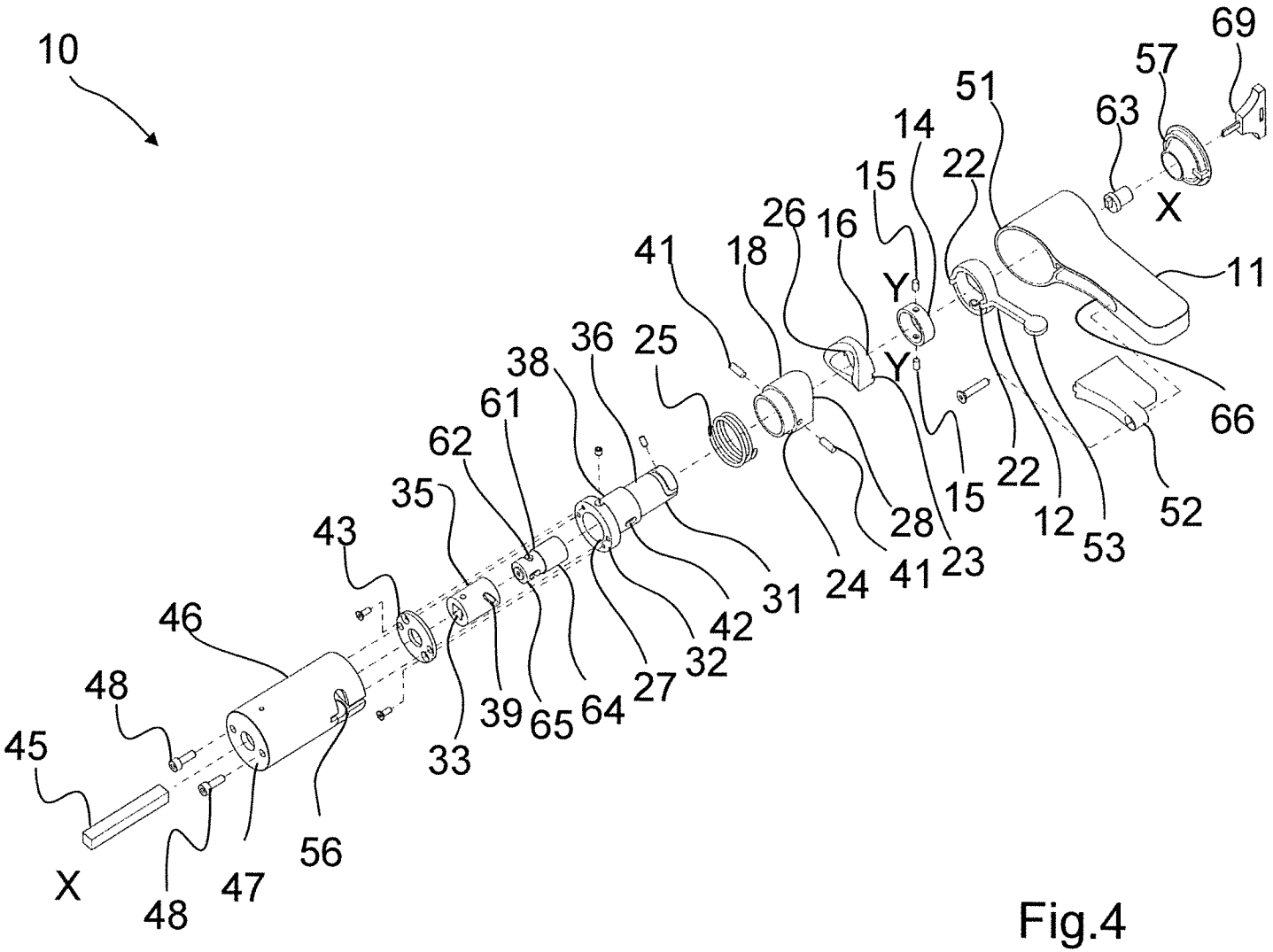
FIG. 4 is an exploded view of a multi-directional handle according to the present invention.

With reference to the Figures, a preferred embodiment of the multidirectional handle 10 of the present invention is shown and described. It will be immediately obvious that numerous variations and modifications (for example related to shape, sizes, various colours and parts with equivalent functionality) can be made to what is described, without departing from the scope of the invention as appears from the enclosed claims.

The multidirectional handle 10 of the invention comprises a grip 11 assembled rotatable on a handle body 46 hollow around its first axis X-X and sliding on the handle body 46 in the direction of the first axis X-X, and is adapted to be assembled on a door associated with an European or recessed lock or an Anglo-Saxon or American lock.

The hollow handle body 46, preferably of a cylindrical shape, contains therein the components of the handle 10.

The grip 11 comprises at an end thereof a hollow supporting element 51, preferably of cylindrical shape, sliding on the handle body 46 in the direction of the first axis X-X of the handle body 46 and of the supporting element 51, in order to allow the grip 11 to slide with respect to the handle body 46 in the direction of the first rotation axis X-X of the grip 11.

The supporting element 51 is further rotatable around the first axis X-X of the handle body 46 and of the supporting element 51, in order to allow the grip 11 to rotate with respect to the handle body 46.

The handle 10 of the invention comprises a lever 12 associated with the grip 11, preferably by means of a blocking element 52 connected to the grip 11; preferably the blocking element 52 is inserted inside a seat 66 obtained in the grip 11, for example a through seat 66, and is connected to the grip 11, for example through a screw, preferably an expansion screw, or through a fit-in insertion in the seat 66.

The lever 12 is further associated with a lever support 14 assembled rotatable on a hollow internal support 31, preferably of a cylindrical shape, and is adapted to rotate together with the grip 11 and the lever support 14 around the first axis X-X.

The lever 12 is assembled oscillating on the lever support 14 in order to rotate around a second axis Y-Y perpendicular to the first rotation axis X-X of the handle, for example pivoted on two pins 15 connected to the lever support 14, driven by the grip 11 of the handle 10 associated therewith when it slides in the direction of the first axis X-X of the handle body 46 and of the supporting element 51; preferably, the lever support 14 and the end of the lever 12 in contact therewith have an annular shape and the two pins 15 are inserted inside two radial and symmetrical holes obtained in the lever support 14; alternatively, the two pins 15 are inserted inside two radial and symmetrical holes in the annular-shaped end of the lever 12 or are made in a single piece with the annular-shaped end of the lever 12, and are further inserted inside two radial and symmetrical holes obtained in the lever support 14, or inside two shaped cavities of a known type obtained in the lever support 14 and adapted to allow the rotation of the pins 15 around the axis Y-Y and to prevent their displacement in the direction of the axis X-X.

Preferably, the lever 12 comprises an extreme part 53 having a curved surface, which is assembled inside the grip 11.

The end of the lever 12 of an annular shape, in contact with the lever support 14, is contained in the handle body 46, while its extreme part 53 having a curved surface is contained in the grip 11 of the handle 10.

In a preferred way, the extreme part 53 of the lever 12 is assembled in the blocking element 52, inside a shaped seat 54 having an internal surface 55 complementary with the curved extreme part 53 of the lever 12.

Preferably, the extreme part 53 of the lever 12 is assembled tangent to the internal surface 55 of the blocking element 52 connected to the grip 11, blocking element 52 which is adapted to control the rotation movement of the lever 12 around the pins 15 and the second axis Y-Y, making its extreme part 53 move during the movement of the grip 11 in the direction of the first axis X-X of the handle body 46.

The blocking element 52 is further adapted to control the rotation movement of the lever 12 around the first axis X-X, rotating together with the grip 11 of the handle 10 to which it is connected.

In the wall of the handle body 46 a slit 56 is obtained, for passing the lever 12; to allow the rotation movements of the lever 12 around the first axis X-X and the oscillating movement around the second axis Y-Y of the pins 15, the slit 56 is preferably shaped as a cross, with an arm extending in the direction of the first axis X-X and the other arm perpendicular thereto.

The handle 10 comprises a first hollow cam element 16, preferably of a cylindrical shape, having a first end in contact with the lever 12 and a second end 26 having a cam profile.

The lever 12 is associated with the first cam element 16 and is adapted to transmit to the first cam element 16 the rotary motion around the first axis X-X of the grip 11 associated thereto; the lever 12, when performing its oscillating motion around the second axis Y-Y, is further adapted to transmit to the first cam element 16 the sliding motion of the grip 11 in the direction of the first axis X-X of the handle body 46.

Preferably, the lever 12 rests on the first cam element 16, for example by means of two teeth 22 obtained on the end of the annular-shaped lever 12 in contact with the lever support 14, which are inserted in two recesses 23 obtained on the first end of the first cam element 16 in contact with the lever 12.

The teeth 22 obtained on the lever 12, inserted in the recesses 23 obtained on the first cam element 16, are adapted to transmit the rotary motion around the first axis X-X of the grip 11 and of the lever 12 associated thereto to the first cam element 16.

Preferably, the teeth 22 and the recesses 23 are placed on axes perpendicular to the second axis Y-Y of the two pins 15 around which the lever 12 performs the oscillating movement and perpendicular to the first rotation axis X-X of the handle 10.

The multidirectional handle 10 of the invention further comprises a second hollow cam element 18, preferably of a cylindrical shape, and with a cam profile at a first end 28 thereof in contact with the second end 26 of the first cam element 16, also having a cam profile.

The two cam profiles of the two ends 26 and 28, mutually in contact, of the first cam element 16 and of the second cam element 18 are complementary and have such a shape as to change the heights of the first cam element 16 and of the second cam element 18 in the direction of the first rotation axis X-X of the handle 10.

The two cam profiles of the two ends 26 and 28 of the first cam element 16 and of the second cam element 18 are adapted to convert the rotary motion of the first cam element 16, of the grip 11 and of the lever 12 associated therewith, into a translation motion of the second cam element 18, as will be explained below in more detail.

The second cam element 18 comprises a stopper element 24, preferably a shoulder 24, obtained on a second end thereof opposite to its first end 28 having a cam profile, the stopper element 24 being adapted to form a first stopper surface for an elastic element 25, preferably a helical spring 25; the internal support 31 has a projecting base 32 adapted to form a second stopper surface 34 for the elastic element 25.

The elastic element 25 is adapted to keep in contact the first cam element 16 with second cam element 18, as will be explained below in more detail.

The internal support 31 comprises an opening 27 obtained in the base 32; the base 32 is composed for example of a circular crown projecting from the external surface of the internal support 31 and forms a second stopper surface 34 for the helical spring 25, which is transverse, preferably perpendicular, to the first rotation axis X-X of the handle 10 and to the external surface of the internal support 31.

In addition to the base 32, the internal support 31 comprises a first sector 38 with lower diameter than the base 32, and a second sector 36 with lower diameter than the first sector 38.

The first cam element 16 is assembled put on the external surface of the second sector 36 and the second cam element 18 is assembled put on the external surface of the first sector 38, with the cam profiles of their respective ends 26 and 28 kept mutually in contact by the thrust of the elastic element 25.

The handle 10 of the invention comprises a revolving element 35, preferably of a cylindrical shape, assembled rotatable around the first axis X-X and connected to a connecting bar or "quadrotto" 45.

The revolving element 35 is assembled rotatable around the first axis X-X, preferably inside the internal support 31, in the first sector 38, in order to abut against a first step 37 which is formed between the first sector 38 and the second sector 36 of the internal support 31, and has a diameter substantially equal to the internal diameter of the first sector 38.

The revolving element 35 comprises a cam slot 39 and is associated with the second cam element 18 by means of connection elements 41 inserted in the cam slot 39, preferably composed of two pegs 41 inserted inside two holes obtained in the second cam element 18; the pegs 41 cross the internal support 31 next to two longitudinal slots 42 obtained in the first sector 38 of the internal support 31 in order to leave the pegs 41 free of sliding inside the slots 42, when the second cam element 18 moves along the direction of the first axis X-X.

The connection elements 41 inserted in the cam slot 39 of the revolving element 35 are adapted to convert the translation motion of the second cam element 18 into a rotary motion of the revolving element 35 and of the connecting bar or "quadrotto" 45 connected thereto, as will be explained below in more detail.

Preferably, the pegs 41 are inserted in the holes obtained in the second cam element 18 which are perpendicular to the first rotation axis X-X of the handle 10.

The connecting bar or "quadrotto" 45 connected to the revolving element 35 is hollow, has a polygonal section, preferably a squared one, and is adapted to connect the handle 10 to a lock, for example of the recessed type, installed in a door; preferably the connecting bar or "quadrotto" 45 is fastened in a known way to the revolving element 35, for example is welded thereto.

Preferably, the connecting bar or "quadrotto" 45 is housed inside a hollow 33, whose section is equal to the one of the connecting bar 45, which is obtained at an end of the revolving element 35.

Optionally, the handle 10 of the invention comprises a closing disk 43, fastened in a known way, for example screwed, to the base 32 of the internal support 31 in order to close the opening 27, keeping the revolving element 35 inside the first sector 38; the closing disk 43 is perforated to allow the passage of the connecting bar or "quadrotto" 45.

The handle body 46, inside which the components of the handle 10 are assembled, has a closed end 47 and the opposite end open and adapted to be closed by a cover 57.

In particular, the closed end 47 of the handle body 46 is perforated to allow the passage of the connecting bar or "quadrotto" 45; in the embodiment which does not comprise the closing disk 43, the hole of the closed end 47 has a lower diameter than the one of the revolving element 35, to keep the revolving element 35 inside the first sector 38.

The internal support 31 contained in the handle body 46 is connected to the handle body 46, preferably is fastened to the closed end 47 of the handle body 46 with screws 48 having projecting heads from the closed end 47 whose function is preventing the rotation of the handle body 46, and consequently of the handle 10, with respect to the door.

Optionally, the handle 10 of the invention can comprise a closing element or cylinder 61 assembled rotatable in the internal support 31, comprising a shaped groove 62 adapted to block the handle 10, preventing the movement of the pegs 41, and therefore of the second cam element 18, along the direction of the first axis X-X, preventing in this way the rotation of the connecting bar or "quadrotto" 45.

The cylinder 61 comprises a first part 64 inserted inside the second sector 36 of the internal support 31, in order to abut against a second step 67 formed in the second sector 36 of the internal support 31.

The cylinder 61 comprises a second part 65 inserted inside an upper seat 68 obtained in the revolving element 35, in the area next to the cam slot 39.

The shaped groove 62 is obtained in the second part 65 of the cylinder 61 and is adapted to house the two pegs 41 which are inserted in the cam slot 39 and in the two holes obtained in the second cam element 18.

The shaped groove 62 comprises a part transverse to the first axis X-X which is adapted to prevent the movement of the second cam element 18, thereby blocking the rotation of the connecting bar or "quadrotto" 45 and the handle 10, and a longitudinal part which allows the movement of the second cam element 18 and the unlock of the handle 10.

Preferably, the cylinder 61 is connected to a pawl 63 and/or to a key 69.

The operation of the handle 10 according to the present invention will now be described.

The handle 10, and in particular the grip 11 with its rotary motion with respect to the handle body 46 around the first axis X-X and with its motion with respect to the handle body 46 along the direction of the first axis X-X, control the rotation of the connecting bar or "quadrotto" 45.

During the rotation around the first axis X-X of the grip 11, with respect to the handle body 46, the blocking element 52 connected to the grip 11 generates the rotation of the lever 12 connected thereto with respect to the first axis X-X.

The lever 12 in turn transmits the rotation motion to the first cam element 16, due to the teeth 22 obtained on the lever 12, which are inserted in the recesses 23 obtained on the first cam element 16.

The rotary motion of the first cam element 16 makes the second end 26 of the first cam element 16, having a cam profile, slide on the first end 28 of the second cam element 18, also with a cam profile, generating the movement of the second cam element 18 along the direction of the first axis X-X of the handle 10.

This movement of the second cam element 18 along the direction of the first axis X-X of the handle 10 occurs both with the clockwise rotation of the lever 12 and of the grip 11 associated thereto and with their anti-clockwise rotation.

In this phase, the first cam element 16 and the second cam element 18 are preferably kept mutually in contact due to the action of the elastic element 25.

The motion of the second cam element 18, and of the pegs 41 connected thereto, along the direction of the first axis X-X of the handle 10 is then transmitted from the pegs 41 to the cam slot 39 of the revolving element 35, making it rotate.

Together with the rotation of the revolving element 35 there is the rotation of the connecting bar or "quadrotto" 45 connected thereto, and consequently the handle 10 is adapted to control the latch of a lock of an European or recessed type connected to the "quadrotto", installed in a door.

The grip 11, during its movement with respect to the handle body 46 along the direction of the first axis X-X, generates the rotation of the lever 12 connected thereto around the second axis Y-Y around which the lever 12 performs its oscillating movement, preferably by means of the blocking element 52 connected to the grip 11.

This rotation around the second axis Y-Y occurs both when the grip 11 is pushed towards the handle body 46, and when the grip 11 is pulled along the opposite direction.

The lever 12 in turn transmits the displacement motion along the direction of the first axis X-X of the handle body 46 to the first cam element 16, preferably due to the teeth 22 obtained on the lever 12, which are inserted in the recesses 23 obtained on the first cam element 16.

The motion of the first cam element 16 along the direction of the first axis X-X moves the second end 26 of the first cam element 16, which is kept in contact with the first end 28 of the second cam element 18, preferably through the elastic element 25, generating the movement of the second cam element 18 along the direction of the first axis X-X of the handle 10.

The motion of the second cam element 18, and of the pegs 41 connected thereto, along the direction of the first axis X-X of the handle 10 is then transmitted from the pegs 41 to the cam slot 39 of the revolving element 35, making it rotate.

Together with the rotation of the revolving element 35, there is the rotation of the connecting bar or "quadrotto" 45 connected thereto, and consequently the handle 10 is adapted to control the latch of a lock of an European or recessed type, installed in a door.

Advantageously, the multi-directional handle of the invention allows making a handle which can be assembled on doors having an already installed recessed lock for adding a multidirectional opening mechanism without having to replace the lock.

What is claimed is:

1. A multidirectional handle comprising:

a grip assembled on a hollow handle body rotatable around a first axis of the handle body and sliding in the direction of the first axis of the handle body;

a lever associated with the grip and with a lever support assembled rotatable on an internal support contained in the handle body, adapted to rotate together with the grip and the lever support around the first axis of the handle body, the lever being assembled oscillating on the lever support in order to rotate around a second axis perpendicular to the first axis of the handle body when the grip associated with the lever slides along the direction of the first axis of the handle body;

a first cam element associated with the lever and with a second cam element, the lever being adapted to transmit to the first cam element the sliding motion of the grip along the direction of the first axis of the handle body, the first cam element and the second cam element being adapted to convert the rotary motion of the first cam element, of the grip and of the lever associated therewith, into a translation motion of the second cam element;

a revolving element assembled rotatable around the first axis and associated with the second cam element by means of cam-type connecting elements, the cam-type connecting elements being adapted to convert the translation motion of the second cam element into a rotary motion of the revolving element; and a connecting bar connected to the revolving element and adapted to connect the handle to a lock.

2. The multidirectional handle of claim 1, wherein the first cam element has a first end in contact with the lever and a second end having a cam profile, and the second cam element has a cam profile at a first end thereof in contact with the second end of the first cam element, the two cam profiles of the two ends of the first cam element and of the second cam element being adapted to convert the rotary motion of the first cam element, of the grip and of the lever associated therewith, into a translation motion of the second cam element; and wherein the cam-type connecting elements comprise a cam slot of the revolving element and comprise connection elements associated with the second cam element and inserted in the cam slot for converting the translation motion of the second cam element into a rotary motion of the revolving element.

3. The multidirectional handle of claim 2, comprising a closing element assembled rotatable in the internal support, comprising a shaped groove adapted to block the handle for preventing the movement of the connection elements, and therefore of the second cam element, along the direction of the first axis, preventing in this way the rotation of the connecting bar.

4. The multidirectional handle of claim 2, wherein the second cam element comprises a stopper element obtained on a second end thereof opposite to its first end having a cam profile, the stopper element being adapted to form a first stopper surface for an elastic element, and wherein the internal support has a projecting base adapted to form a second stopper surface for the elastic element, to keep the first cam element in contact with the second cam element.

5. The multidirectional handle of claim 1, wherein the lever is associated with the grip by means of a blocking element connected to the grip, and wherein the lever has an end with an annular shape in contact with the lever support which is contained in the handle body, and an extreme part having a curved surface which is assembled in the blocking element, inside a shaped seat having an internal surface complementary with the extreme curved part of the lever.

6. The multidirectional handle of claim 1, wherein the internal support contained in the handle body is fastened to a closed end of the handle body with screws having projecting heads from the closed end whose function is preventing the rotation of the handle body, and consequently of the handle, with respect to the door, the closed end of the handle body being perforated to allow the passage of the connecting bar.

7. The multidirectional handle of claim 1, comprising a closing disk fastened to the base of the internal support to keep the revolving element inside the internal support, the closing disk comprising a hole to allow the passage of the connecting bar.

8. The multidirectional handle of claim 1, wherein the connection elements are composed of two pegs inserted inside two holes obtained in the second cam element.

9. The multidirectional handle of claim 8, wherein the pegs cross the internal support next to two longitudinal slots obtained in the internal support in order to leave the pegs free of sliding inside the slots, when the second cam element moves along the direction of the first axis.

10. The multidirectional handle of claim 4, wherein the elastic element is a helical spring.

* * * * *